US010277968B2

(12) United States Patent
Qiu et al.

(10) Patent No.: US 10,277,968 B2
(45) Date of Patent: Apr. 30, 2019

(54) MICROPHONE WITH DUSTPROOF THROUGH HOLES

(71) Applicant: Goertek.Inc, Weifang, Shandong (CN)

(72) Inventors: Guanxun Qiu, Weifang (CN); Qinglin Song, Weifang (CN)

(73) Assignee: Goertek.Inc, Weifang, Shandong (CN)

( * ) Notice: Subject to any disclaimer, the term of this patent is extended or adjusted under 35 U.S.C. 154(b) by 0 days.

(21) Appl. No.: 15/521,151

(22) PCT Filed: Jan. 5, 2015

(86) PCT No.: PCT/CN2015/070128
§ 371 (c)(1),
(2) Date: Apr. 21, 2017

(87) PCT Pub. No.: WO2016/109924
PCT Pub. Date: Jul. 14, 2016

(65) Prior Publication Data

US 2017/0332161 A1 Nov. 16, 2017

(51) Int. Cl.

| | |
|---|---|
| ***H04R 25/00*** | (2006.01) |
| ***H04R 1/08*** | (2006.01) |
| ***H04R 19/00*** | (2006.01) |
| ***H04R 19/04*** | (2006.01) |
| ***H04R 1/02*** | (2006.01) |

(52) U.S. Cl.
CPC ..... *H04R 1/083* (2013.01); *H04R 1/02* (2013.01); *H04R 19/005* (2013.01); *H04R 19/04* (2013.01); *H04R 2201/003* (2013.01)

(58) Field of Classification Search
CPC ..... H04R 1/02; H04R 1/083; H04R 1/222; H04R 19/005; H04R 19/04; H04R 2201/003; B81B 3/0072; B81B 7/0061; B81B 2201/0257; B81B 2201/0264
USPC ..... 381/113, 116, 174, 175, 369, 191; 29/25.41, 594; 367/170, 174, 181
See application file for complete search history.

(56) References Cited

U.S. PATENT DOCUMENTS 5,452,268 A * 9/1995 Bernstein ..... H04R 19/005 367/181
6,535,460 B2 * 3/2003 Loeppert ..... B81B 3/0072 367/181

(Continued)

FOREIGN PATENT DOCUMENTS

CN 101018424 A 8/2007
CN 101426163 A 5/2009

(Continued)

*Primary Examiner* — Huyen D Le
(74) *Attorney, Agent, or Firm* — Michele V. Frank; Venable LLP

(57) ABSTRACT

The present invention discloses a microphone, comprises: a silicon substrate; a diaphragm disposed over the silicon substrate; a backplate disposed over the diaphragm, the backplate having a plurality of through holes formed therein and a barrier structure, and the plurality of through holes being arranged in a through hole pattern on the backplate; the barrier structure having one or more protruding portions extending from at least one part of the through hole wall of the barrier structure, thereby the section shape of at least one through hole being an irregular shape with one or more inwardly concave portion. The microphone provided by the present invention can achieve a better dustproof effect.

6 Claims, 5 Drawing Sheets

(56) References Cited

U.S. PATENT DOCUMENTS

| | | | | |
|---|---|---|---|---|
| 7,400,737 | B2 * | 7/2008 | Pedersen | B81B 3/0072 381/175 |
| 7,466,834 | B2 * | 12/2008 | Ogura | B81B 7/0061 381/174 |
| 7,912,236 | B2 | 3/2011 | Dehe et al. | |
| 8,327,711 | B2 * | 12/2012 | Kasai | H04R 19/005 73/649 |
| 2011/0075866 | A1 * | 3/2011 | Zhang | H04R 1/222 381/174 |

FOREIGN PATENT DOCUMENTS

| | | | |
|---|---|---|---|
| CN | 102822084 | A | 12/2012 |
| CN | 103402163 | A | 11/2013 |
| WO | 2014/194062 | A1 | 12/2014 |

* cited by examiner

Fig.3a（PRIOR ART）

Fig. 4a（PRIOR ART）

MICROPHONE WITH DUSTPROOF THROUGH HOLES

This application is a National Stage of International Application No. PCT/CN2015/070128 filed on Jan. 5, 2015, which is hereby incorporated by reference in its entirety.

TECHNICAL FIELD

The present invention relates generally to a microphone, more particularly, to a microphone with dustproof through holes.

BACKGROUND

U.S. Pat. No. 7,912,236, discloses a sound transducer structure having a perforated backplate with multiple circular through holes extending through the backplate. However, if the diameters of the circular through holes formed in the backplate are overlarge, alien particles would easily pass through those large circular holes and drop into the sound cavity of the sound transducer structure, which may form a leakage path, resulting in the microphone being disabled.

SUMMARY

The present invention is directed to providing a microphone with better dustproof effect.

A microphone provided according to embodiments of the present invention comprising:

a silicon substrate;

a diaphragm disposed over the silicon substrate;

a backplate disposed over the diaphragm, the backplate having a plurality of through holes formed therein and a barrier structure;

the plurality of through holes being arranged in a through hole pattern on the backplate;

the barrier structure having one or more protruding portions extending from at least one part of the through hole wall of the barrier structure, thereby the section shape of at least one through hole being an irregular shape with one or more inwardly concave portions.

In an alternative embodiment, the section shape of the at least one through hole is an approximate Y-type shape with an inwardly concave portion, an approximate polygon with an inwardly concave portion, or an approximate circle with an inwardly concave portion.

In an alternative embodiment, the protruding portion of the barrier structure has a thickness smaller than or equal to the thickness of the backplate.

In an alternative embodiment, the silicon substrate is a substrate with a through hole therein.

In an alternative embodiment, an insulation layer is disposed between the silicon substrate and the diaphragm.

In an alternative embodiment, an insulation layer is disposed between the diaphragm and the backplate to form an air gap therebetween.

In an alternative embodiment, the microphone is a standalone MEMS microphone or a CMOS integrated system-on-chip microphone.

By arranging through holes with an irregular shape in the backplate, a backplate provided with a specific through hole pattern may be formed according to the embodiments of the present invention. Compared to an existing backplate with a conventional through hole pattern, the backplate provided by the invention can prevent the larger particles from dropping into the microphone through the through holes, thus resulting in good dustproof effect.

BRIEF DESCRIPTION OF THE DRAWINGS

For a more complete understanding of the present invention, and the advantages thereof, reference is now made to the following descriptions taken in conjunction with the accompanying drawings, in which:

FIGS. 3*a* and 3*b* show the section shapes contrasting an existing Y-type through hole with a Y-type through hole according to one embodiment of the invention.

FIGS. 4*a* and 4*b* illustrate the contrast of an existing backplate through hole pattern and a backplate through hole pattern according to one embodiment of the present invention.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION

Figure 1:
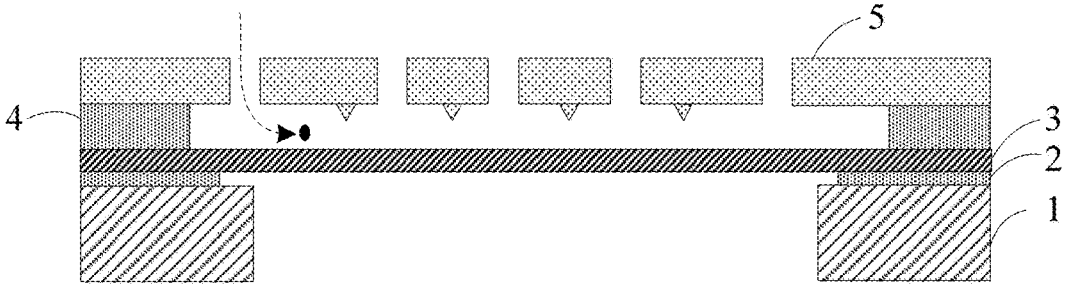
FIG. 1 illustrates a structural schematic diagram of a MEMS microphone according to one embodiment of the invention.

The making and using of some embodiments are discussed in detail below. It should be appreciated, however, that the present disclosure provides many applicable inventive concepts that can be embodied in a wide variety of specific contexts. The specific embodiments discussed are merely illustrative of specific ways to make and use the disclosure, and do not limit the scope of the disclosure.

It is understood that the following disclosure provides many different embodiments, or examples, for implementing different features. Specific examples of components and arrangements are described below to simplify the present disclosure. These are of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over a second feature in the description that follows may include embodiments in which the first and second features are formed in direct contact, and may also include embodiments in which additional features may be formed interposing the first and second features, such that the first and second features may not be in direct contact.

FIG. 1 illustrates a structural schematic diagram of a MEMS microphone according to one embodiment of the invention. As shown in FIG. 1, one or more through holes may be formed in a silicon substrate 1, and an insulation layer 2 may be disposed on the silicon substrate 1. A diaphragm 3 may be disposed on the insulation layer 2 and another insulation layer 4 may be disposed on the diaphragm 3. A backplate 5 may be disposed on the insulation layer 4 and suspended over the diaphragm 3 such that an air gap may be formed between the diaphragm 3 and the backplate 5.

A plurality of through holes may be formed in the backplate 5. The inventor of the present application discovers that if some larger through holes are formed in the backplate 5, the noise of the microphone would be decreased, thereby a higher signal to noise ratio (SNR) can be achieved. However, external particles would easily be dropped, through the larger through holes, into the sound cavity formed between the backplate 5 and the diaphragm 3, therefore the performance of the microphone is affected.

The present invention provides a means of arranging a through hole pattern on the backplate, as a result, the signal to noise ratio (SNR) of the microphone may be improved and meanwhile large particles may be prevented from dropping into the microphone.

Figure 2:
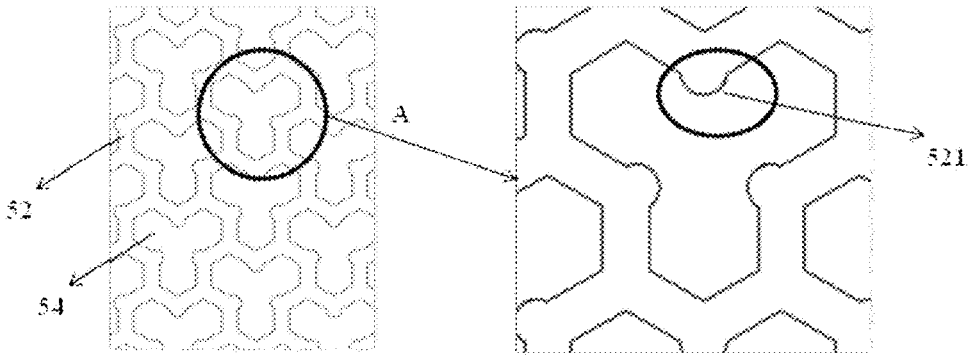
FIG. 2 illustrates a diagram representing a backplate through hole pattern according to one embodiment of the invention.

FIG. 2 illustrates a diagram representing a backplate through hole pattern according to one embodiment of the invention, in which the right figure is the enlarged drawing for the portion A of the left figure. As shown in FIG. 2, a barrier structure 52 of the backplate 5 and a plurality of through holes 54 constitute a backplate through hole pattern together. Each through hole 54 may be a substantial Y-type shape. However, as one or more protruding portions 521 may be extending from the edges (also referred to as the through hole wall) of the barrier structure 52, each through hole 54 may be a shape having one or more inwardly concave portions when viewed from the top.

Figure 3B:
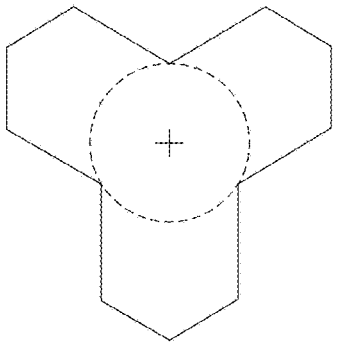
Figure 3B:
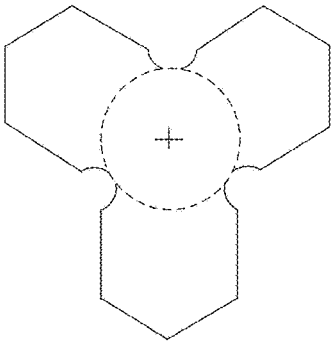

Further referring to FIGS. 3*a*-3*b*, FIG. 3*a* is the section view of an existing Y-type through hole, and FIG. 3*b* is the section view of a Y-type through hole according to one embodiment of the invention, wherein the dotted lines in the FIGS. 3*a* and 3*b* show the available areas for large particles to pass through. Since the barrier structure is provided with protruding portions, compared to the existing Y-type through holes, the Y-type through holes of the present embodiment can prevent the particles with larger diameters from dropping into the microphone through the through holes.

Figure 4B:
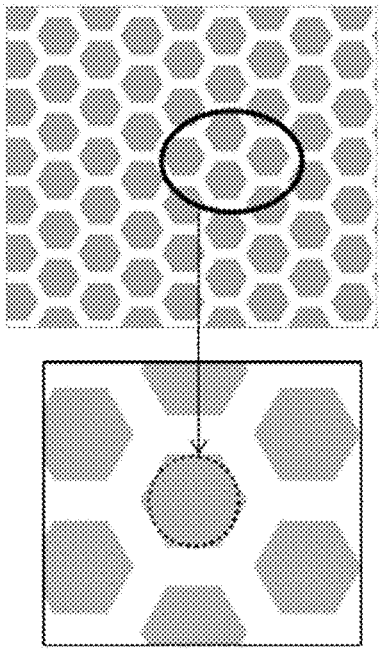
Figure 4B:
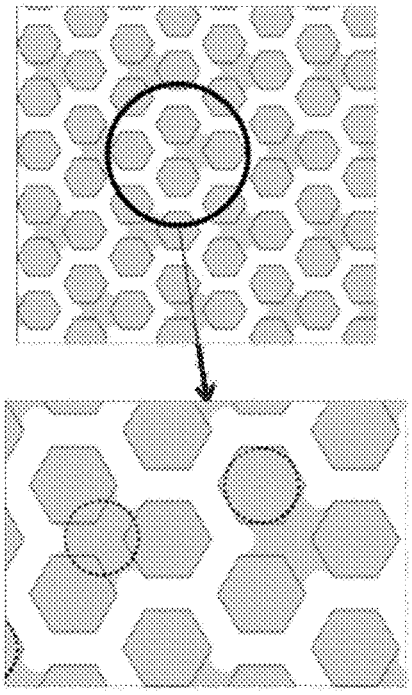

FIGS. 4*a* and 4*b* illustrate the contrast of an existing backplate through hole pattern and a backplate through hole pattern according to the one embodiment of the invention. FIG. 4*a* is a conventional backplate through hole pattern, and each through hole is formed with a regular hexagon. The backplate with the conventional hexagonal backplate through hole pattern shown in FIG. 4*a* has an opening ratio of 49%, and the dotted circular represents that the through hole may allow for the particles with a maximum diameter of about 7 μm passing therethrough. FIG. 4*b* is a backplate through hole pattern according to one embodiment of the present invention, wherein the section shape of each through hole is an approximate Y-type shape. As shown in FIG. 4*b*, each Y-type through hole is formed by removing the barrier materials among the three normally hexagonal through holes while remaining portions of the barrier materials extending from the walls of the adjacent two hexagonal through holes. Compared to the conventional backplate through hole pattern shown in FIG. 4*a*, the backplate with the Y-type through hole pattern shown in FIG. 4*b* may have an opening ratio of 65%, thus the SNR can be increased by 3 dB. Since the barrier structure is provided with protruding portions, each Y-type through hole has a shape with one or more inwardly concave portions as a consequence, and may remain the particles with the diameter larger than about 7 μm incapable of passing through the through holes.

Figure 5A:
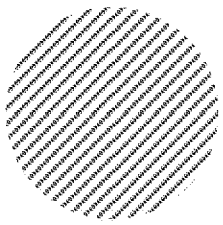
Fig.5a (PRIOR ART)
FIGS. 5*a* to 5*d* show the section shapes contrasting an existing backplate through hole with the backplate through holes according to the embodiments of the invention.
Figure 5B:
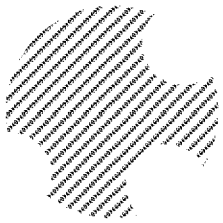
Figure 5C:
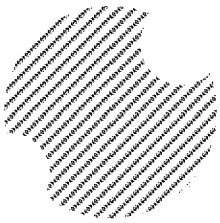
Figure 5D:
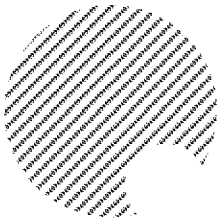

FIGS. 5*a*-5*d* illustrate the section shapes contrasting an existing backplate through hole with the backplate through holes according to the embodiments of the invention. FIG. 5*a* shows the through hole formed in the backplate may be a normal circular shape under conventional conditions. In the embodiment of the present invention, one or more protruding portions may be formed from the edge of the barrier structure 52 surrounding each through hole, and thus the section shapes of respective circular through holes have corresponding inwardly concave portions, as shown in FIG. 5*b*-5*c*, thereby preventing the larger particles from dropping into the through holes.

Figure 6:
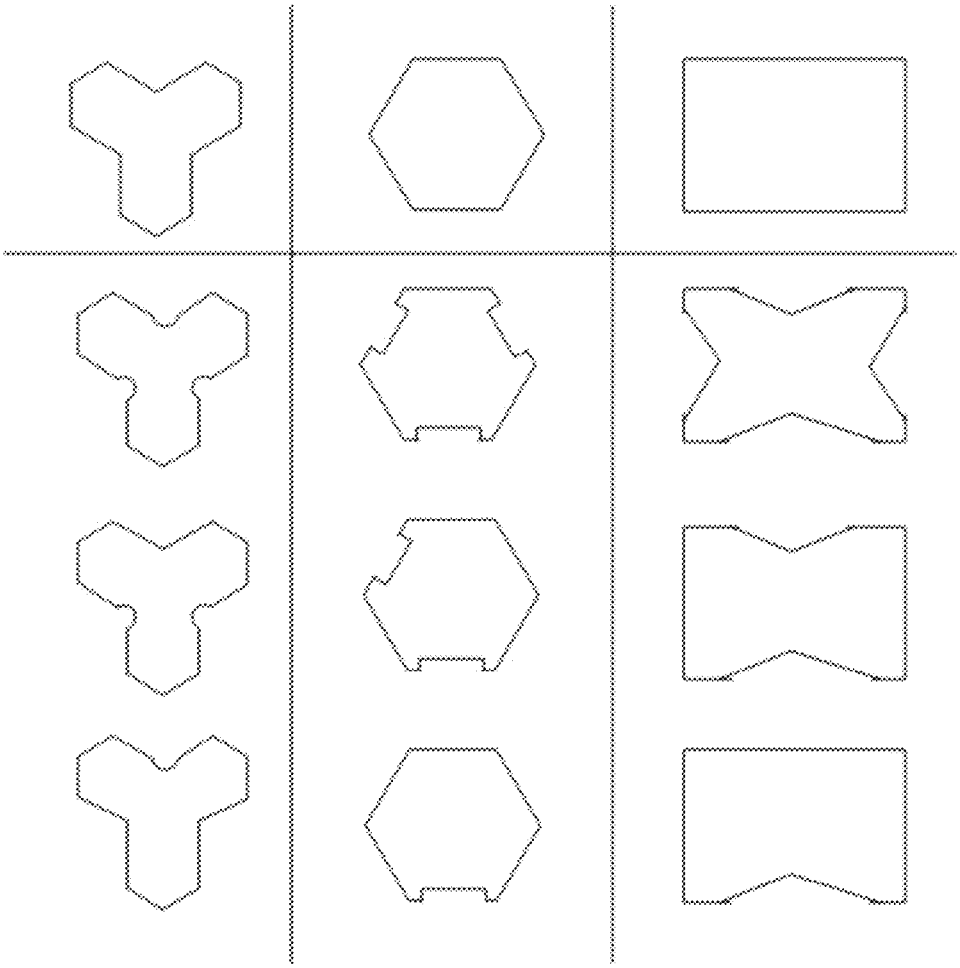
FIG. 6 shows the section shapes contrasting an existing backplate through hole with the backplate through holes according to the embodiments of the invention.

FIG. 6 illustrates the section shapes contrasting an existing backplate through hole with the backplate through holes according to the embodiments of the invention. As shown in FIG. 6, the section shape of the existing backplate through hole may be Y-type, hexagonal or rectangular. In order to prevent the particles in the external environment from dropping into the microphone through the through holes, one or more protruding portions may be formed along at least one edge of the barrier structure surrounding each through hole, thereby forming the through holes with irregular shapes having inwardly concave portions according to the embodiments of the present invention. The resulting through holes allow for the particles having a diameter smaller than the particles passing through the conventional through hole, therefore the larger particles can be prevented from dropping into the resulting through holes. The protruding portion may be formed with any suitable shape, such as circle, rectangle or triangle, etc.

Figure 7A:
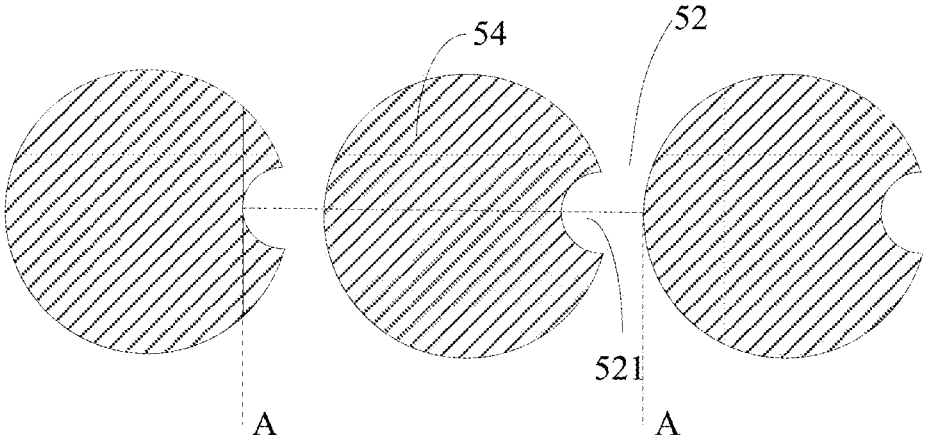
FIG. 7*a* is a diagram of a backplate through hole pattern according to one embodiment of the prevent invention.
Figure 7B:
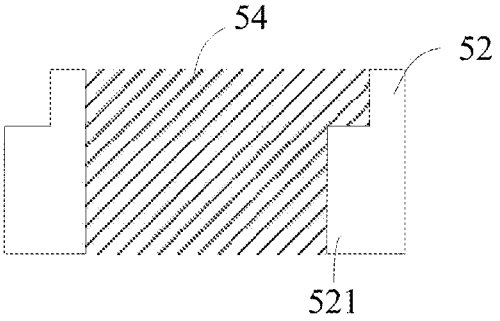
FIG. 7*b* is a cross-section view of the backplate through hole pattern along the A-A line shown in FIG. 7*a*.

FIG. 7*a* is a diagram of a backplate through hole pattern according to one embodiment of the invention. FIG. 7*b* is a cross-section view of the backplate through hole pattern along the A-A line in FIG. 7*a*. As shown in FIGS. 7*a* and 7*b*, the through holes formed in the backplate are roughly circular, and the barrier structure 52 may be provided with a protruding portion 521 partially extending from the wall of the through hole 54 in the thickness direction of the backplate. Referring to FIG. 7*b*, the thickness of the protruding portion 521 is smaller than the thickness of the backplate (i.e. the thickness of the barrier structure 52).

According to the above described embodiments, one person skilled in the art would appreciate that a plurality of through holes with irregular shapes may be arranged in the backplate, thereby forming a backplate with a specific through hole pattern. In the embodiments of the present invention, the backplate 5 may be formed by the following materials: the semiconductor materials such as polysilicon and monocrystalline silicon, the insulation materials such as silicon oxide and silicon nitride, the conductor materials such as Al, Au, Cr, Ni, Ti, etc., or the composite layers of the above materials. The backplate with the specific through hole pattern according to the embodiments of the invention can be applied to a stand-alone microphone or a CMOS integrated system-on-chip microphone, and thus such microphones can perform a better dustproof effect. Furthermore, in some embodiments, such microphones can present a higher signal to noise ratio.

Moreover, the scope of the present application is not intended to be limited to the particular embodiments of the process, machine, manufacture, compositions of matter, means, methods and steps described in the specification. As one of ordinary skill in the art will readily appreciate from the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A microphone, comprising:

a silicon substrate;

a diaphragm disposed over the silicon substrate;

a backplate disposed over the diaphragm, the backplate having a plurality of through holes formed therein and a barrier structure, and the plurality of through holes being arranged in a through hole pattern on the backplate;

the barrier structure having one or more protruding portions extending from at least one part of the through hole wall of the barrier structure, thereby a section shape of at least one through hole being an irregular shape with one or more inwardly concave portions, wherein the protruding portion of the barrier structure has a thickness smaller than the thickness of the backplate.

2. The microphone according to claim 1, wherein the section shape of the through hole is an approximate Y-type shape with an inwardly concave portion, an approximate polygon with an inwardly concave portion, or an approximate circle with an inwardly concave portion.

3. The microphone according to claim 1, wherein the silicon substrate is a substrate with a through hole therein.

4. The microphone according to claim 3, wherein an insulation layer is disposed between the silicon substrate and the diaphragm.

5. The microphone according to claim 4, wherein an insulation material is disposed between the diaphragm and the backplate to form an air gap between the backplate and the diaphragm.

6. The microphone according to claim 1, wherein the microphone is a stand-alone MEMS microphone or a CMOS integrated system-on-chip microphone.

* * * * *